US006132063A

United States Patent [19]

Byers

[11] Patent Number: 6,132,063

[45] **Date of Patent: *Oct. 17, 2000**

[54] APPARATUS FOR ARRANGING DECORATIVE LIGHTS

[75] Inventor: Thomas L. Byers, Mustang, Okla.

[73] Assignee: Gary Products Group, Inc., Lubbock, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 09/189,461

[22] Filed: Nov. 10, 1998

[51] Int. Cl.[7] ..... F21S 13/14

[52] U.S. Cl. ..... 362/252; 362/249; 362/250; 362/238

[58] Field of Search ..... 362/252, 249, 362/122, 123, 806, 808, 250, 238, 239

[56] References Cited

U.S. PATENT DOCUMENTS

| | | | |
|---|---|---|---|
| D. 287,769 | 1/1987 | Davis | D26/25 |
| D. 347,598 | 6/1994 | Maddox, Jr. | D11/118 |
| D. 374,097 | 9/1996 | Aiken | D26/25 |
| 1,778,597 | 10/1930 | Herzog . | |
| 2,113,038 | 4/1938 | Thalinger | 41/15 |
| 2,919,810 | 1/1960 | Pease | 211/26 |
| 3,096,943 | 7/1963 | Forrer | 240/10 |
| 3,674,612 | 7/1972 | Gehl, Jr. | 161/23 |
| 3,677,867 | 7/1972 | Westlund | 161/14 |
| 4,404,621 | 9/1983 | Mauro | 362/419 |
| 4,736,282 | 4/1988 | Ahroni | 362/123 |
| 4,968,541 | 11/1990 | McCrory | 428/9 |
| 5,359,502 | 10/1994 | Cantin | 362/250 |
| 5,823,659 | 10/1998 | Klose | 362/252 |

*Primary Examiner*—Sandra O'Shea
*Assistant Examiner*—Bertrand Zeade
*Attorney, Agent, or Firm*—Locke Liddell & Sapp LLP

[57] ABSTRACT

A frame for arranging decorative lights in a conical or Christmas tree shape is provided. The frame is a spiral-shaped frame which defines a plurality of openings for holding decorative lights. The frame includes a plurality of revolutions and preferably has a U-shaped or channel-shaped cross section. The frame provides a means for concealing wires that connect the decorative lights to one another and is collapsible from a substantially flat or storage position to a display position in which the frame defines a Christmas tree or conical shape.

11 Claims, 9 Drawing Sheets

72
76
114
74
60,64
112
104
32
120a
30
120b
10, 20
120c
30
120d
36
30
120e 120f
30
132
120g
30
130
30
134
120h
82
30
136
120i
30
120j
30
120k
94
106
34,54
88

APPARATUS FOR ARRANGING DECORATIVE LIGHTS

BACKGROUND OF THE INVENTION

This invention relates to a spiral-shaped frame for arranging decorative lights, and more specifically to a collapsible spiral frame for arranging decorative lights in the shape of a Christmas tree.

Artificial Christmas trees are well known. Patents granted on artificial trees include U.S. Pat. No. 4,968,541 to McCrory, U.S. Pat. No. 3,677,867 to Westlund and U.S. Pat. No. Des. 347,598 to Maddox, Jr. McCrory discloses a collapsible artificial tree comprised of circular hoops having a plurality of limbs secured thereto. The Westlund patent discloses a collapsible artificial tree for suspension from a ceiling. The tree is formed by a continuous spring-like conically shaped spiral frame member having an electrical conductor wrapped around the frame. The frame member has a plurality of convolutions adapted to be collapsed into a generally flat spiral configuration for storage purposes. The Maddox, Jr. design patent discloses a spiral-shaped "Bouncing Christmas Tree."

Although there are a number of artificial Christmas trees in the prior art, including spiral-shaped artificial trees, nothing in the prior art discloses a collapsible structure with means for mounting lights thereto so that when the structure is extended to a display position, the lights attached thereto define a conical, or Christmas tree shape. One manner for attempting to create a Christmas tree shape with decorative lights is by hanging individual light strings from a center post and allowing the light strings to drape downwardly over an object having a cone or Christmas tree shape. Individual light strings can also be attached at one end to a structure above the ground and at the opposite end to the ground therebelow wherein the lower end of each light string is spaced from the upper end in an attempt to create a cone or Christmas tree shape. Such methods do not provide a consistent, uniform-looking shape and require a large amount of effort which must be repeated each time it is desired to create the desired shape.

Accordingly, it is an object of the present invention to provide a collapsible frame which may be collapsed into a storage position and which is easily extendable into a conical or Christmas tree shape. It is a further object of the invention to provide a collapsible frame which is very compact for storage.

It is a further object of the invention to provide a collapsible frame that includes a means for mounting and arranging decorative lights so that when the frame is extended to a display position, the lights define a conical, or Christmas tree shape. It is a further object of the invention to provide such a collapsible frame which is attractive when erected and which has lights that can be attached thereto and stored with the frame so that there is no need to remove the lights from season to season. These objects as well as other objects of the present invention will become more readily apparent after reading the following description in conjunction with the accompanying drawings.

SUMMARY OF THE INVENTION

In accordance with the present invention, a collapsible frame is provided which extends into a conical or Christmas tree shaped display position. When the frame is in its collapsed position, it is substantially flat so that it can be easily stored when not in use. The frame in its display position defines a conical or Christmas tree shape. A plurality of light receptacles is defined on the frame. Each of the receptacles is adapted to receive and hold a decorative light. The receptacles are arranged so that when the lights are received therein, the lights will define a conical or Christmas tree shape when the frame is in the display position.

The frame is preferably a spiral frame having a plurality of revolutions of increasing and preferably constantly increasing radius from the center of the spiral to the outer end thereof. The frame is preferably channel shaped and has an upper panel, which may also be referred to as a mounting plate, having first and second outer edges. A pair of spaced-apart legs extend from the outer edges of the upper panel and define a space therebetween.

Preferably, the light receptacles comprise openings defined in the upper panel of the channel shape. The light receptacles may also include mounting bosses positioned over the openings and extending from the upper surface of the upper panel. The lights are preferably inserted from the lower surface of the upper panel upward through the opening and into the mounting boss. Thus, connecting wires which connect the decorative lights to one another are concealed in the space between the legs such that the legs comprise a concealing means for concealing the connecting wires. Preferably, the light receptacles in the frame are spaced apart an equal distance peripherally from one another.

The frame preferably has a center or apex portion which is adapted to be suspended from a hanging element thereabove or which may be placed on a center post having a sufficient height to allow the frame to extend into its display position. The apparatus may further include spacers extending from the apex portion of the frame through the revolutions to the lowermost revolution of the frame. The spacers maintain a desired vertical spacing between revolutions when the frame is in the display position. Preferably, the spacer comprises a transparent string having knots spaced at various intervals corresponding to the desired spacing of the revolutions.

The apparatus may further comprise two substantially identical frames connected to one another to form a double spiral frame. The first and second frames are movable together and thus are collapsible from the display position to the storage position and extendable therefrom back to the display position when connected together. The second frame is preferably rotated 180° from the first frame when connected thereto. The frames are connected at their respective apex portions, and when connected to one another can be suspended from a hanging element thereabove or positioned atop a center or vertical post.

BRIEF DESCRIPTION OF THE DRAWINGS

FIG. 6 is a perspective view of the embodiment of FIG. 2 in the collapsed position.

FIGS. 15 and 16 are section views of alternative channel shapes which can be utilized.

DESCRIPTION OF A PREFERRED EMBODIMENT

Figure 1:
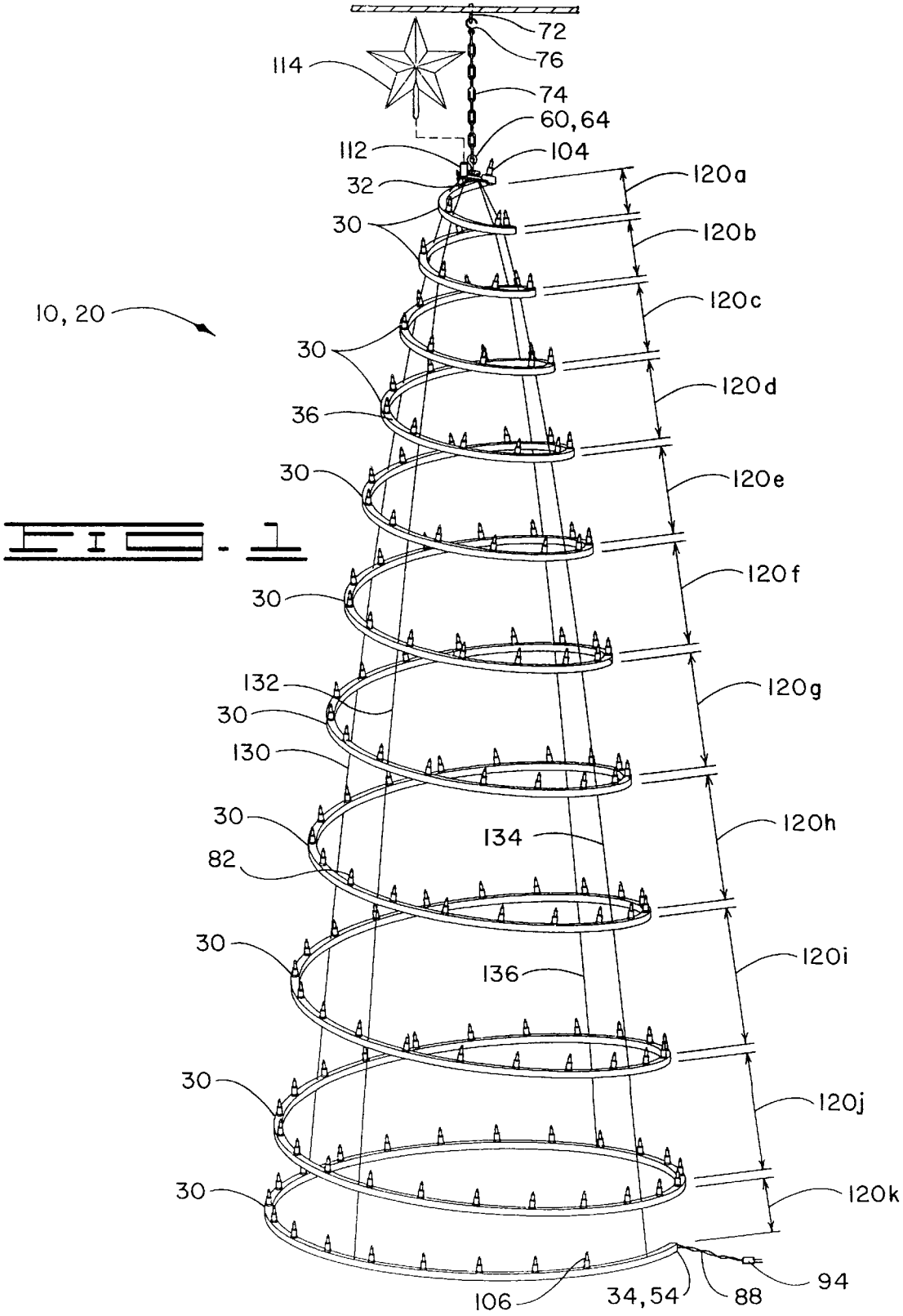
FIG. 1 is a perspective view of an embodiment of the apparatus of the present invention comprising one spiral frame in a display position.
Figure 3:
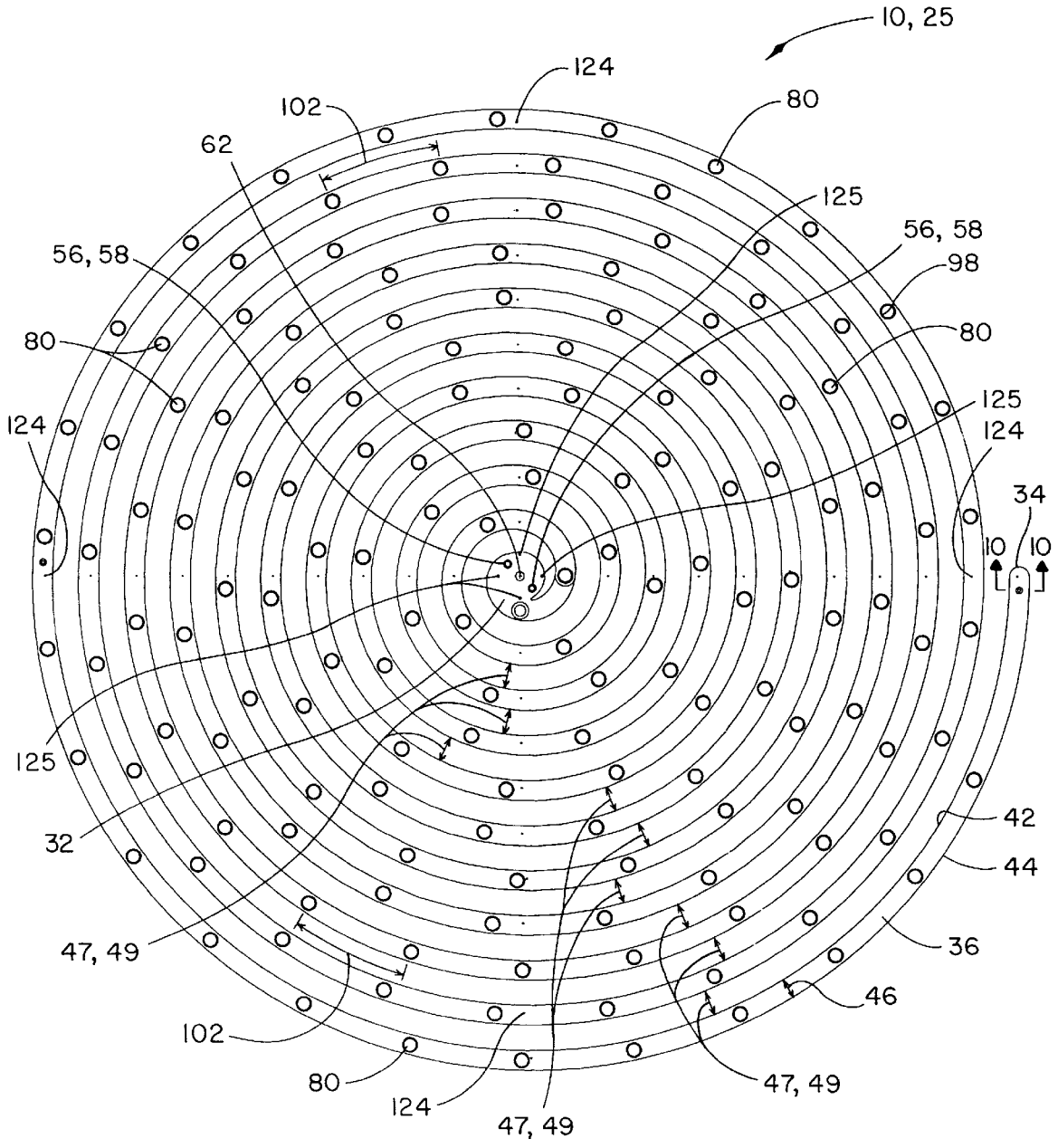
FIG. 3 is a top view of the embodiment of FIG. 1 in the collapsed position without the lights attached thereto.
Figure 5:
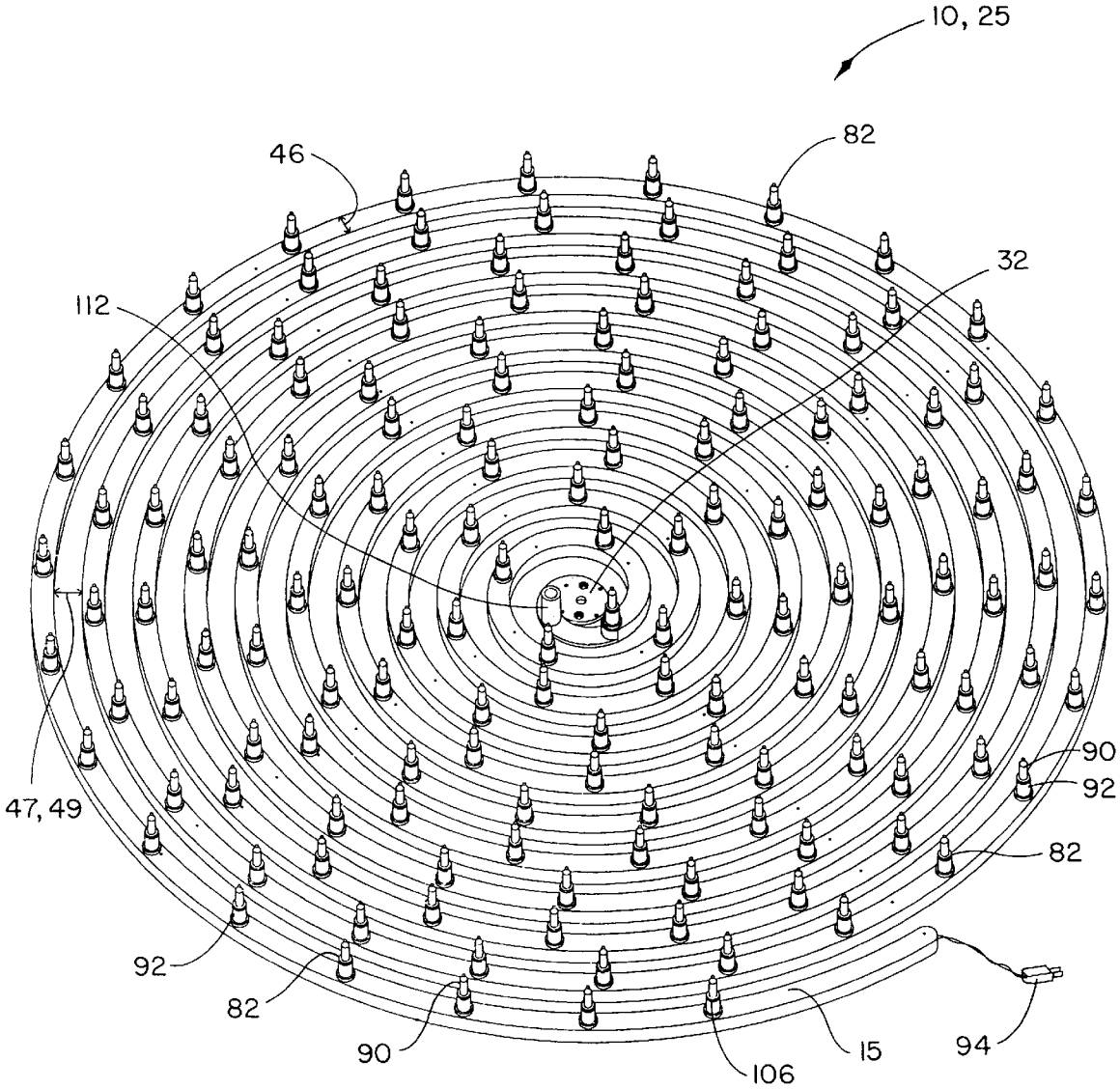
FIG. 5 is a perspective view of the embodiment shown in FIG. 1 in the collapsed position.
Figure 5:
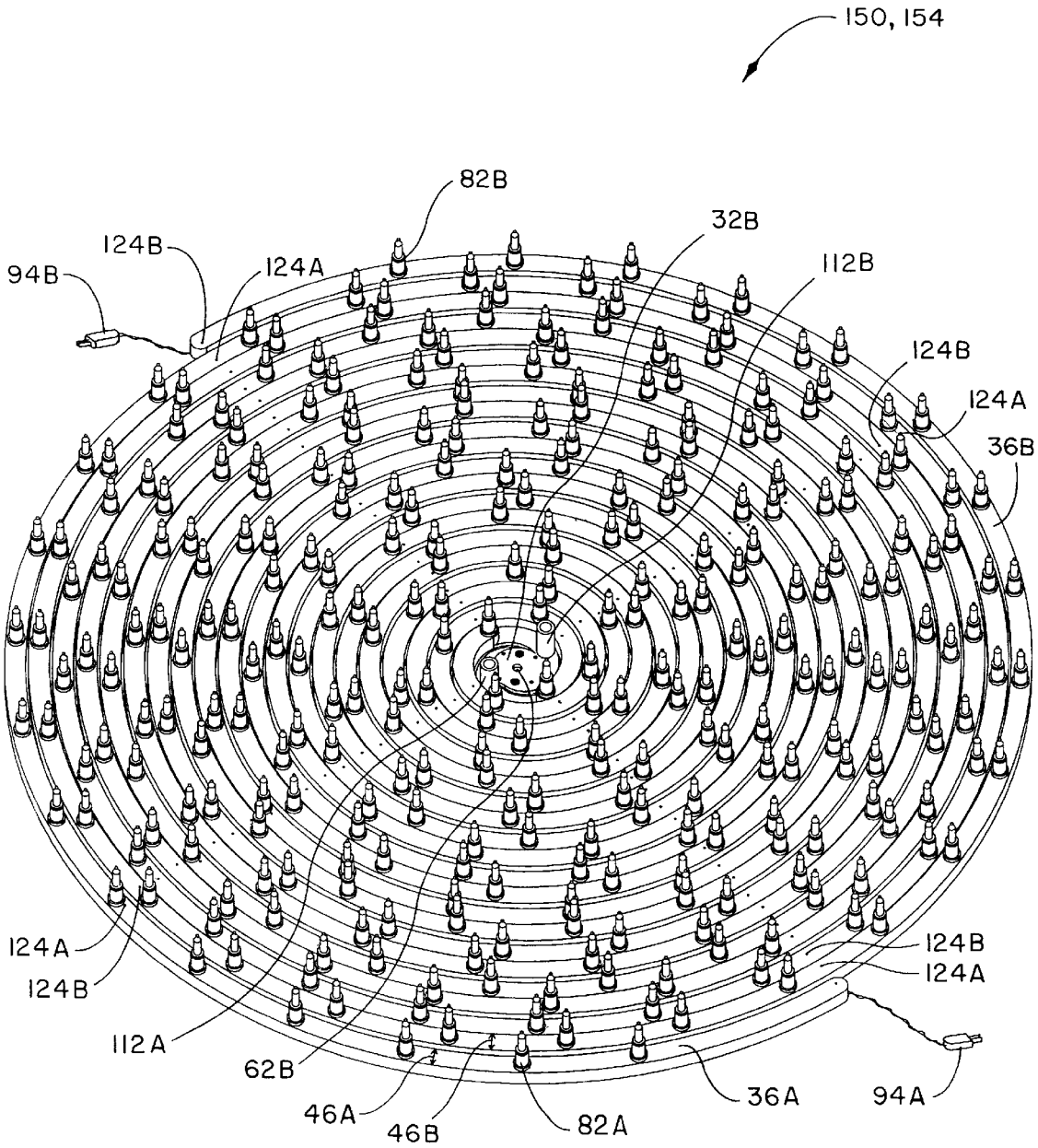
Figure 7:
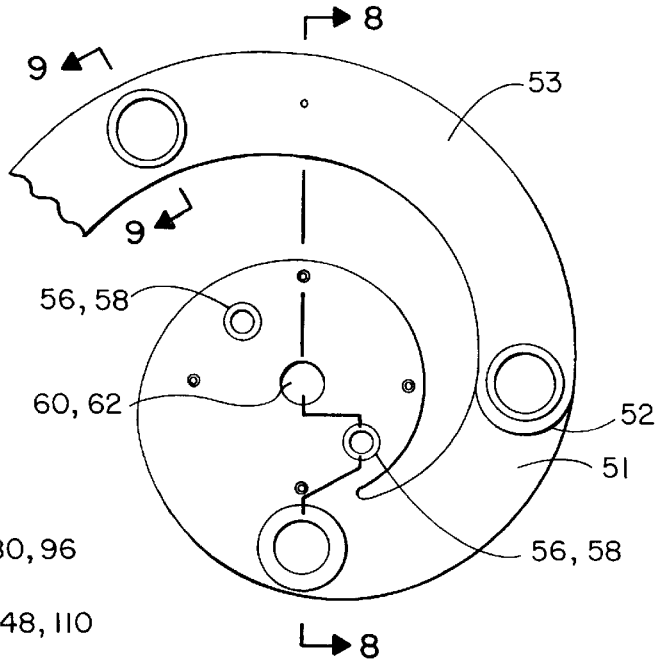
FIG. 7 is an enlarged view of the apex or center portion of a frame of the present invention.

Referring now to the figures and more particularly to FIG. 1, an apparatus for arranging decorative lights 10 is shown. Apparatus 10 comprises a frame 15 which is movable from a display or extended position 20 as shown in FIG. 1 to a collapsed or storage position 25 as shown in FIGS. 3 and 5. Apparatus 10 is repetitively collapsible to storage position 25 and extendable to display position 25 therefrom.

Figure 8:
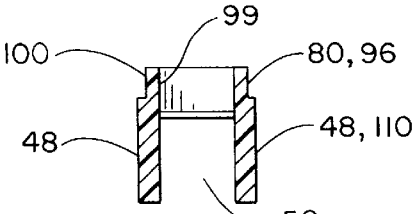
FIG. 8 is a cross-sectional view from line 8—8 of FIG. 7.
Figure 9:
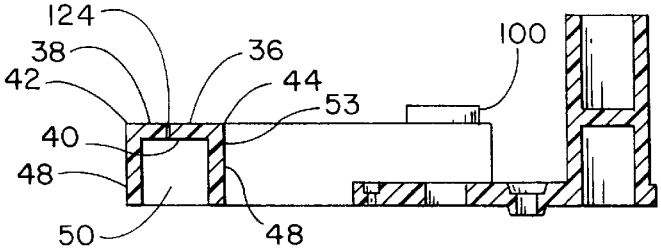
FIG. 9 is a cross-sectional view from line 9—9 of FIG. 7.

Frame 15 is preferably a spiral or coiled frame having a plurality of revolutions 30. Frame 15 has a center, or apex portion 32 and terminates at an outer end 34. Spiral frame 15 preferably has a channel-shaped or generally U-shaped cross section as shown in FIGS. 8 and 9. Spiral frame 15 thus may comprise a mounting plate or upper panel 36 having upper and lower surfaces 38 and 40, respectively. Mounting plate 36 has first and second outer edges 42 and 44 defining a width 46. A pair of legs 48 extend downwardly from first and second edges 42 and 44 and define a space 50 therebetween. As shown in FIG. 3, a space 47 with a width 49 is defined by adjacent revolutions 30 when frame 15 is in collapsed position 25.

Center or apex portion 32 is preferably substantially flat as is a portion of the first of the plurality of revolutions 30. Thus, the frame 15 comprises a flat portion 51 and channel-shaped portion 53 which has a first end 52 near center 32 and a second end 54 which coincides with outer end 34 of frame 15.

Figure 2:
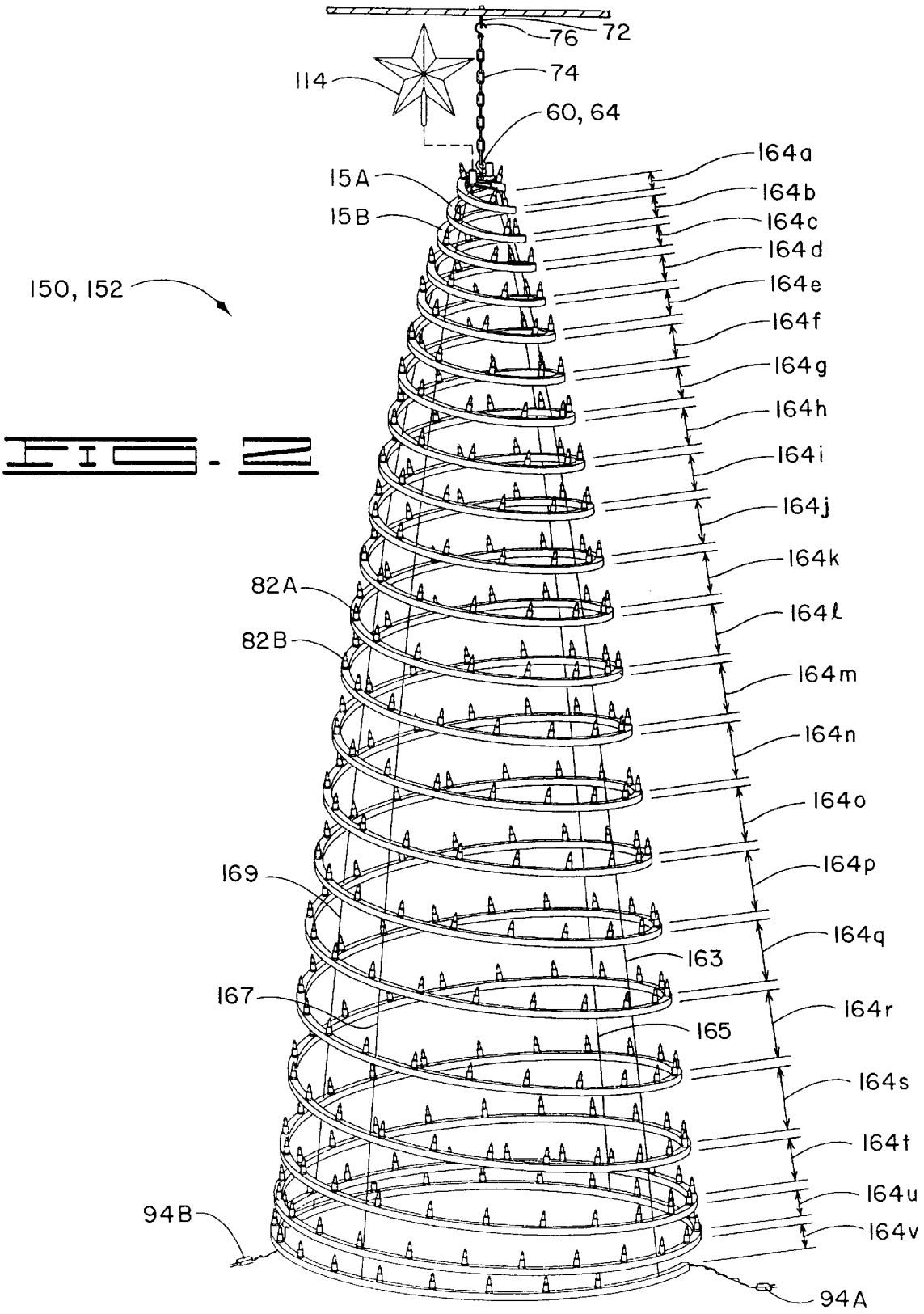
FIG. 2 is a perspective view of an embodiment of the present invention including two spiral frames attached to one another in the display position.
Figure 13:
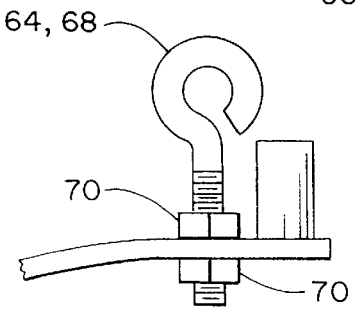
FIG. 13 shows a side view of the suspension member attached to the central portion of the frame.
Figure 10:
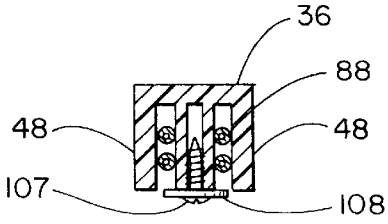
FIG. 10 is a cross-sectional view taken from line 10—10 of FIG. 1.
Figure 11:
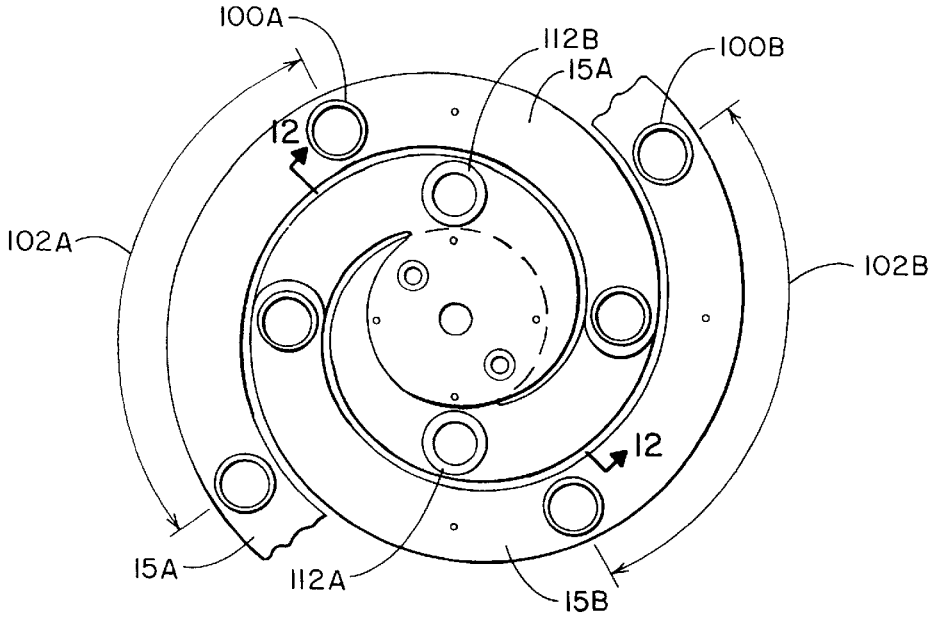
FIG. 11 is an exploded view of the center or apex portions of two frames connected together, without the suspension member.
Figure 12:
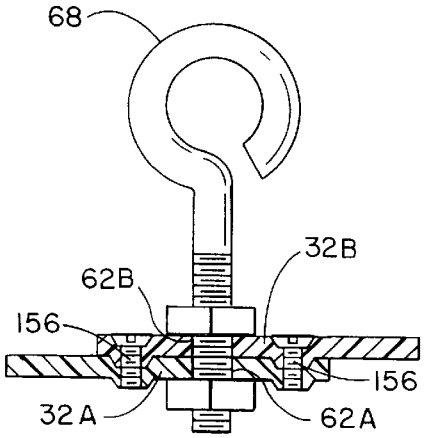
FIG. 12 is a view taken from line 12—12 of FIG. 11.

Center portion 32 has a connecting means 56 which may comprise a pair of holes 58 adapted to receive fasteners of a type known in the art so that a second, substantially identical frame 15 may be connected to the first frame 15 as shown in FIGS. 2 and 12, and as is explained in more detail hereinbelow. Center portion 32 also comprises a suspending means 60 which may include an opening 62 for receiving a suspending fastener 64, such as an eye bolt 68 connected to center 32 with nuts 70 as shown in FIG. 13, adapted to be connected to any type of hook or hanging member 72 thereabove to suspend apparatus 10 in the display position 30.

In the embodiment of FIG. 1, frame 15 has a chain 74 attached to eye bolt 68. Chain 74 is connected to member 72 with a hook 76. As is apparent from the figures, the frame 15 can be suspended from an interior ceiling, or any type of interior or exterior overhang or other structure. Frame 15 may also be positioned over a center post extending upward from a ground, or floor surface. Center portion 30 can be clamped or otherwise mechanically attached to the upper end of a center post in many ways such as, but not limited to, a fastener received through openings 62 and threaded into threads defined on the center post.

Apparatus 10 further includes a light mounting means 80 defined on frame 15 for mounting decorative lights 82 thereto. Decorative lights 82 preferably comprise a light string 84 having a plurality of decorative lights 82. Light string 84 further includes connecting wires 88 extending between and connecting lights 82. Lights 82 may be comprised of light bulbs 90 and bulb sockets 92. Light string 84 further has an electric plug 94 at one end thereof for connecting to an electrical outlet or other power source.

Mounting means 80 may comprise a plurality of light receptacles 96. Light receptacles may comprise openings 98 for receiving and holding lights 82 in place. Light receptacles 96 may further include mounting bosses 100 projecting from upper surface 38 of mounting plate 36 over openings 98. Openings 98 and mounting bosses 100 preferably have a tapered inner surface 99 so that they will frictionally engage bulb sockets 92 to hold lights 82 in place. As shown in FIG. 3, light receptacles 96 are preferably spaced equally a distance 102 peripherally around each revolution 30. In other words, the distance 102 between adjacent lights is substantially identical from a first or top light 104 near center portion 32 to a last light 106 near end 34.

Preferably, connecting wires 88 are positioned beneath lower surface 40 of mounting plate 36. Thus, connecting wires 88 are positioned in space 50 between legs 48, which comprise a concealing means 110 for concealing connecting wires 88. Frame 15 may have a boss 105 for accepting a threaded screw 107. A washer 108 may be received beneath the head of screw 107 to hold connecting wires 98 in space 50. By holding the wires in space 50, washer 108 relieves stress on the wires that might occur due to the weight of plug 94 at the end of wires 88 tending to pull the wire out of space 50. An ornament holder 112 may also be located on center portion 32, or on the flat portion 51 of the first of revolutions 30 near center portion 32. Ornament holder 112 is designed to receive a topping ornament such as star 114 or other ornament.

Apparatus 10 may also include a plurality of spacers 118 adapted to maintain a desired vertical space 120 between revolutions 30 when frame 15 is in display position 20. Vertical spaces 120 include the subscripts a–k for identification purposes in the embodiment of FIG. 1, and to indicate that the magnitude of spaces 120*a*–120*k* may vary from the top to the bottom of the apparatus when it is in display position 20. The number of spaces a–__ will vary depending on the number of revolutions. Spacers 118 may comprise a transparent string 122 or other flexible line, extending through a plurality of holes 124 defined through mounting plate 36 of frame 15. Preferably, center portion 36 has four holes 125 angularly spaced equally 90° from one another adapted to receive a spacer 118. Thus, apparatus 10 preferably includes four spacers 118.

Figure 14:
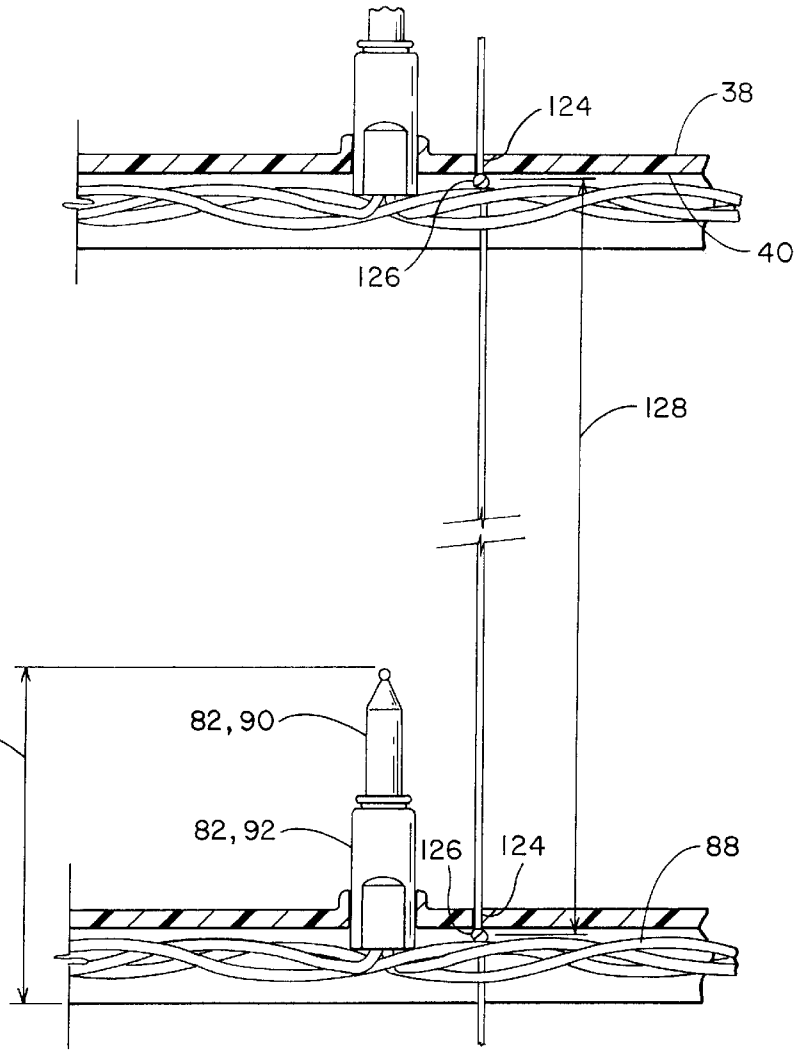
FIG. 14 is a partial section view of two adjacent revolutions of the embodiment of FIG. 1 showing lights mounted in the frame.
Figure 14A:
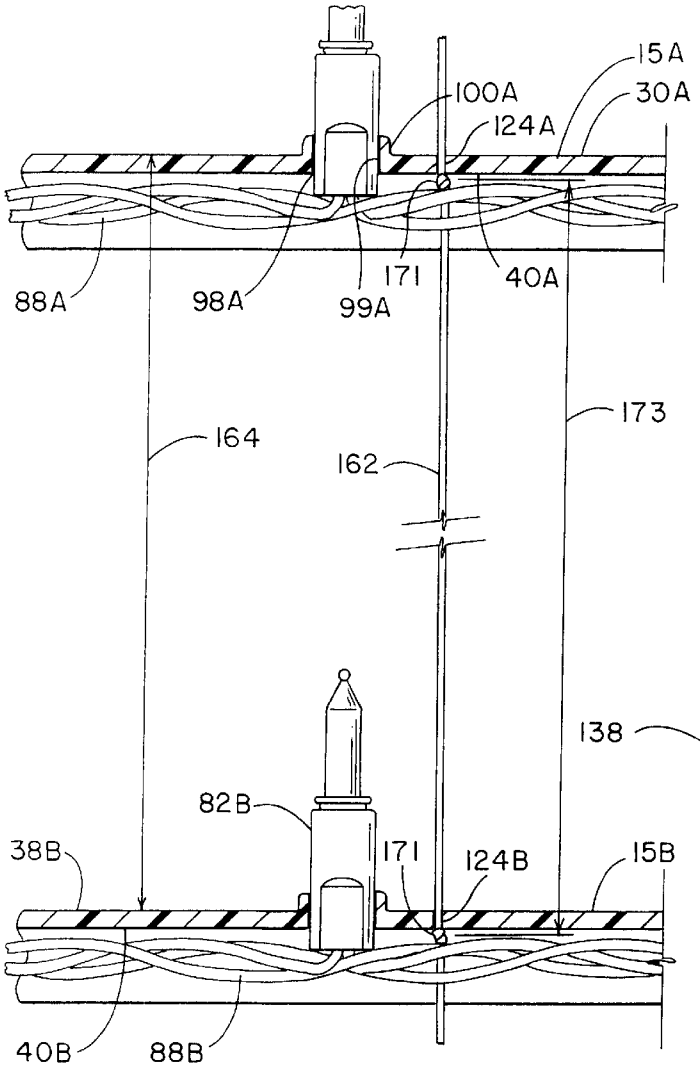
FIG. 14A is a partial section view of two adjacent revolutions of the embodiment of FIG. 2.

As shown in FIG. 14, each spacer may have a plurality of knots 126 defined thereon spaced apart from one another a desired spacing 128 such that mounting plate 36 will rest on nodes, or knots 126 when in the extended, or display position 20 to maintain the desired vertical spacing 120. Each spacer is attached to apex portion 32 at holes 125. In the embodiment shown, spacers 118 may include spacers 130, 132 and 134 each having eleven nodes, and a spacer 136 having ten nodes excluding the attachment of center portion 32. Spaces 128 may be referred to as 128*a*–128*k* to indicate correspondence with spaces 120*a*–120*k*. It is apparent that the invention can have any number of revolutions, and thus any number of spaces 120*a*–120_ and corresponding spaces between nodes 128*a*–128_. FIG. 14 also shows lights 82 received in a light receptacle 96 comprised of openings 98 and mounting bosses 100.

As shown in FIG. 1, apparatus 10 defines a conical or Christmas tree shape when extended to display position 20. Light receptacles 96 are spaced and arranged such that lights received therein likewise define a conical or Christmas tree shape when apparatus 10 is in display position 20. In other words, the outline created by the frame and the lights is substantially conical, or Christmas tree shaped in the display position.

Apparatus 10 is collapsible from display position 20 to storage or collapsed position 25 as depicted in FIGS. 3 and 5. As shown therein, the apparatus is substantially flat having a height 133 which is equal to the combined height of the channel-shaped frame and the portion of lights 82 extending thereabove, so that the entire apparatus can be stored in a substantially flat box when not in use. Apparatus 10 can simply be removed from the flat box, pulled upwardly by the apex portion 32, extended to display position 20 and plugged into a wall outlet or other power source. As is apparent from FIG. 3, the plurality of revolutions which comprise frame 15 are of increasing radius and are preferably of a constantly increasing radius from center 32 to outer end 34.

The embodiment shown in FIGS. 1, 3 and 5 comprise one spiral frame 15. The present invention also includes apparatus 150 for arranging decorative lights. Apparatus 150 is comprised of two frames 15 identified as first and second frames 15A and 15B connected to one another at the center or apex portions thereof. Frames 15A and 15B are substantially identical to frame 15 and include all of the same features. The designations A and B are utilized solely for identification purposes. Like apparatus 10, apparatus 150 is collapsible from a display position 152 shown in FIG. 2 to a collapsed or storage position 154 shown in FIGS. 4 and 6. In collapsed or storage position 154, apparatus 150 is substantially flat and may be stored in a generally flat box. When it is desired to utilize apparatus 150, one simply pulls upward on the connected center portions 32A and 32B of frames 15A and 15B thereof to extend and suspend the apparatus in display position 152.

Figure 4:
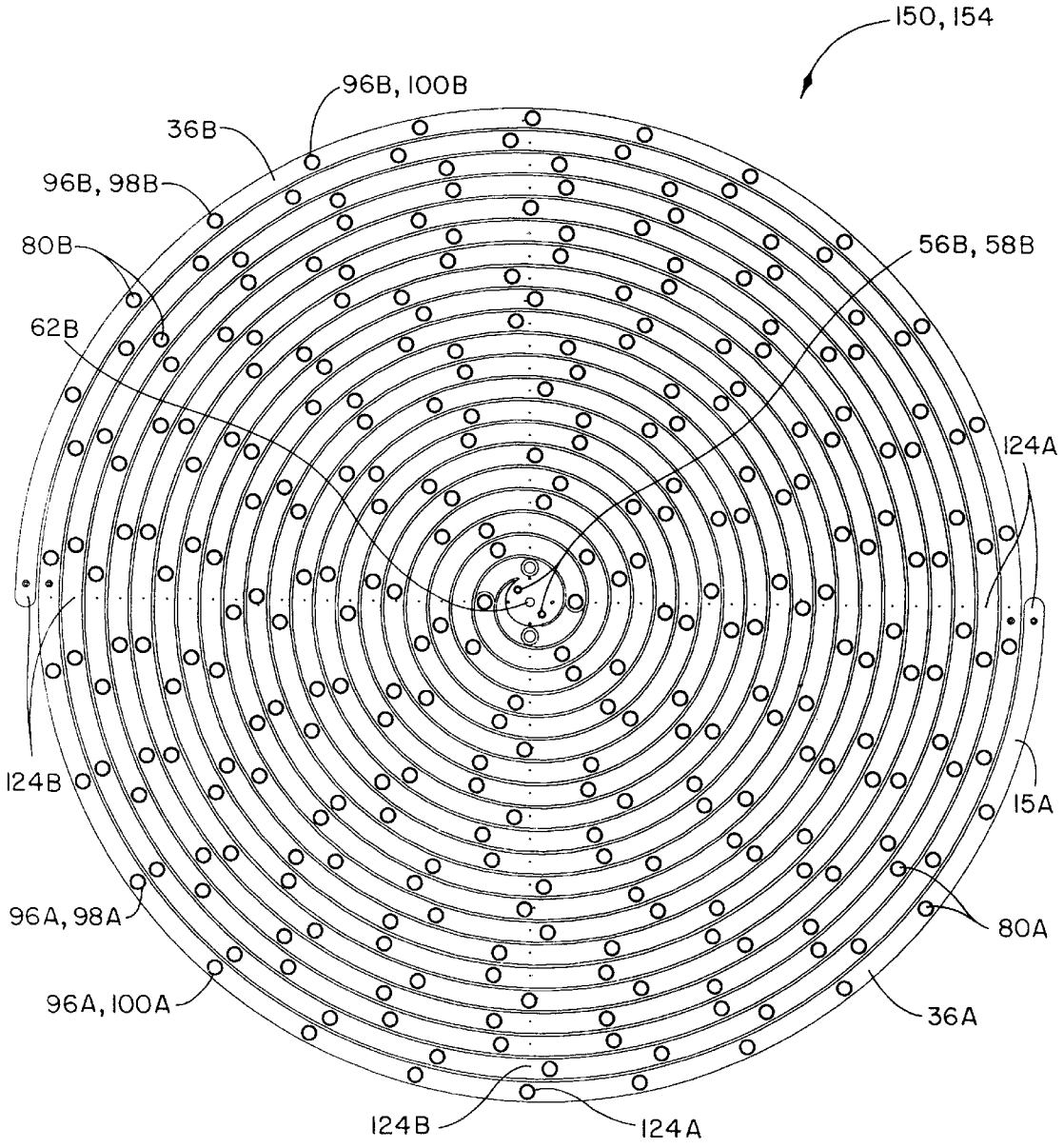
FIG. 4 is a top view of the embodiment of FIG. 2 in the collapsed position without the lights attached thereto.

To connect first and second frames 15A and 15B together, second frame 15B is simply rotated 180° from the position of first frame 15A so that the terminal ends 34A and 34B are 180° apart. As depicted in FIGS. 4 and 6, center portion 32A of first frame 15A is positioned beneath the center portion 32B of second frame 15B. Spaces 47A and 47B between adjacent revolutions in frames 15A and 15B are such that the widths 46A of frame 15A will fit in spaces 47B, and the widths 46B will fit in spaces 47A. Frames 15A and 15B are connected together by fasteners 156 extending through the openings 58A and 58B in frames 15A and 15B respectively. Likewise, eye bolt 68, which may be utilized for suspending the apparatus 150 from a hanging element 72 will extend through center portions 32A and 32B to hold frames 15A and 15B together. Apparatus 150, like apparatus 10, may also be mounted to a center vertical post.

Apparatus 150 includes spacers 162 which, like spacers 118, may comprise transparent string or other flexible line which is received through holes 124A and 124B in frames 15A and 15B. As is apparent from the drawings, the holes 124A will be properly aligned with holes 124B since the frames 15A and 15B are rotated 180° apart. Spacers 162 may consist of spacers 163, 165, 167 and 169 and may have knots or nodes 171 defined thereon at desired intervals 173 so that a desired vertical spacing 164 can be maintained between revolutions in the double spiral frame apparatus 150. Vertical spaces 164 are designated with the subscript a–v in the embodiment of FIG. 2, for identification purposes and to indicate that the magnitude of the spaces 164 may vary and be of different magnitude from the top to the bottom of the apparatus when it is in display position 152. Thus, intervals 173 between nodes 171 on spacers 163, 165, 167 and 169 may vary and may be of different magnitude than adjacent intervals 173 from apex portion 32 to the lowermost revolution when the apparatus 150 is in display position 152. Intervals 173*a*–173*v* will correspond to spaces 164*a*–164*v*. The number of spaces 164 and intervals 173 will vary depending on the number of revolutions of the frames.

Figure 17:
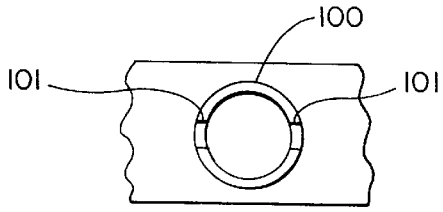
FIG. 17 is a top view of an alternative embodiment of a mounting boss having slots therein.
Figure 18:
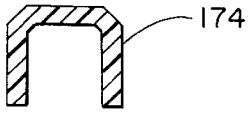
Figure 15:
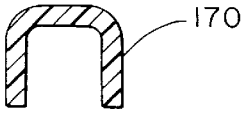

Although the channel-shaped cross section shown herein is essentially a U shape with sharp corners, it is understood that frame 15 is not limited to such a shape and may include, among others, the cross-sectional shapes 170 and 172 shown in FIGS. 15–16, each of which have a concealing means for concealing connecting wires. Further, mounting bosses 100, rather than being continuous as shown in FIGS. 1–14, may have slots 101 defined therein as shown in FIG. 17 so that, if desired, the connecting wires 88 can be placed beneath mounting plate 36 or on the top or upper surface of mounting plate 36 and the lights pushed downwardly into the mounting bosses. Connecting wires 88 may thus be received in slots 101.

The invention may be made from any material capable of being repetitively collapsed and extended, with the ability to repetitively return to a substantially flat shape in the collapsed position, and to repetitively maintain a conical shape in the display position. The preferred material is plastic and more preferably, the frame is an injection-molded plastic frame. The invention thus provides an apparatus which provides for the easy and repetitive arrangement of lights into a Christmas tree shape. The spiral, resilient frame is readily extendable and collapsible and in its collapsed position is easily stored.

Although the invention has been described with reference to specific embodiments, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as falling within the true scope of the claims.

What is claimed is:

1. An apparatus for arranging a plurality of decorative lights, the lights including a plurality of light bulbs and sockets, the sockets being interconnected by wires extending therebetween, the apparatus comprising:

a spiral frame having a plurality of revolutions, said frame being movable between a display position wherein said revolutions are vertically spaced apart and define a conical shape, and a storage position wherein said revolutions are substantially flat; and said frame revolutions having an upper and a lower surface, and a plurality of spaced apart apertures, said apertures adapted to receive and maintain the plurality of sockets in a fixed position, such that the light bulbs extend above said upper surface and are spaced apart by a predetermined distance along said revolutions and the wires are disposed adjacent said lower surface.

2. The apparatus of claim 1 wherein said frame revolutions includes a channel for receiving and concealing the wires.

3. The apparatus of claim 2 wherein said channel includes first and second spaced-apart legs defining a space therebetween adapted to receive and conceal the wires.

4. The apparatus of claim 1 wherein said frame includes a center portion adapted to be suspended from a structure thereabove.

5. The apparatus of claim 1 and further comprising:

at least one spacer extending through said revolutions for maintaining a desired vertical spacing between said revolutions when said frame is in said display position.

6. The apparatus of claim 5 wherein said at least one spacer comprises a flexible line extending from an uppermost revolution to a lowermost revolution of said frame.

7. The apparatus of claim 6 wherein said revolutions include an opening for allowing said line to pass therethrough, said flexible line having nodes defined thereon spaced at desired intervals to maintain said spacing between said revolutions, wherein said revolutions in said display position are supported by said nodes.

8. The apparatus of claim 5, and including four of said spacers, said spacers being spaced ninety degrees apart.

9. The apparatus of claim 1 and further including:

a second substantially identical frame connected to said spiral frame to form a double spiral, said frames being movable together between said storage and said display positions.

10. The apparatus of claim 9, wherein said frames are connected together at respective apexes of said frames.

11. The apparatus of claim 9, wherein said frames are rotated 180° from one another.

* * * * *